United States Patent [19]

Hogan

[11] 4,018,477

[45] Apr. 19, 1977

[54] ADJUSTABLE HEIGHT FRONT EDGE FOR VEHICLE SEAT

[75] Inventor: Gerard T. Hogan, Southington, Conn.

[73] Assignee: UOP Inc., Des Plaines, Ill.

[22] Filed: Nov. 3, 1975

[21] Appl. No.: 627,990

[52] U.S. Cl. ..... 297/284

[51] Int. Cl.[2] ..... A47C 3/00

[58] Field of Search ..... 297/284, 313, 335

[56] References Cited

UNITED STATES PATENTS

| | | | |
|---|---|---|---|
| 3,215,468 | 11/1965 | Swenson et al. | 297/284 |
| 3,446,532 | 5/1969 | Cramer | 297/313 X |
| 3,550,953 | 11/1970 | Neale | 297/284 X |
| 3,632,166 | 1/1972 | Lohr | 297/284 |
| 3,762,769 | 10/1973 | Poschl | 297/284 |

*Primary Examiner*—James C. Mitchell

*Attorney, Agent, or Firm*—James R. Hoatson, Jr.; Philip T. Liggett; William H. Page, II

[57] ABSTRACT

In order to provide seating comfort for different sized passengers, the front or leading edge of the seat cushion section of the vehicle seating unit is made to be raised and lowered to a limited degree by being provided with underlying hinged supporting means and a movable transverse lift bar member which is mounted to be movable through an arcuate path that can, in turn, adjustably raise and lower the front portion of the seat cushion section. For adjustment purposes, the transverse lift bar member can be attached to and made to extend from a pivoted arm member mounted in a manner to move in an arc and in a generally vertical plane along the side of the seating unit.

5 Claims, 3 Drawing Figures

ADJUSTABLE HEIGHT FRONT EDGE FOR VEHICLE SEAT

Figure 1:
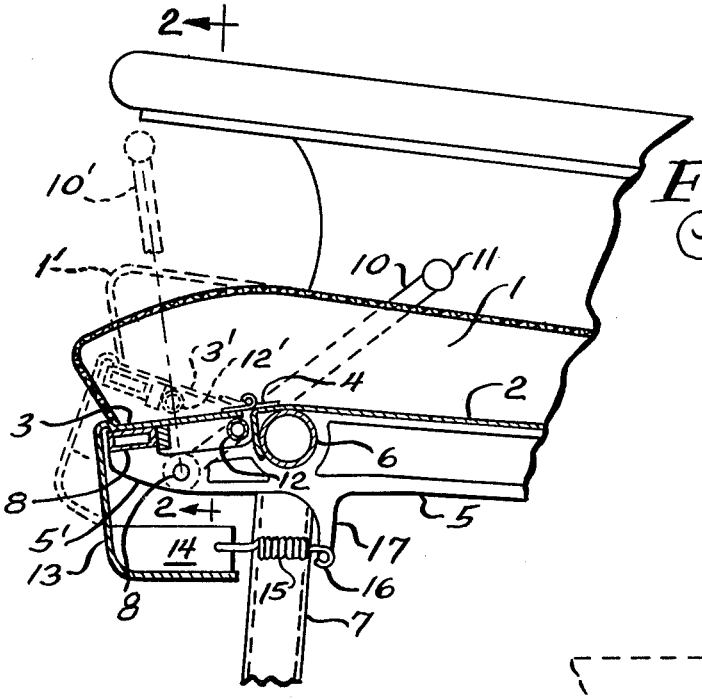

The present invention relates to a specially constructed vehicle seat which provides adjustability as to the height and tilt of the front edge portion of seat cushion section of the seating unit.

More specifically, the present invention provides for improved seating comfort for different sized passengers to use a given seating unit by having a hinged and tilting cushion support section under the front edge portion of the seat cushion section and movable lift means which will, in turn, provide for adjustably lifting and lowering the support means and the front edge portion of the seat cushion.

In connection with passenger carrying vehicles, it is realized that standardized dimensions do not provide for seating comfort for all the different sized persons which will be required to use each seating unit. For a tall person a particular standardized seat may be too low or too shallow, while for a short person the seat may well be too high and/or too deep. However, in considering seating comfort, it has been determined that there can be an improvement by providing for the raising or lowering of just the front edge portion of the seat cushion section of the particular unit by some adjustable increment. The height adjustment, or tilt adjustment, may be of still further advantage when utilized in combination with the tilting of a seat back for a reclining posture. It is, however, not intended to limit the present invention to the combining of an adjustable front edge portion of a seat along with a reclining seat back construction. The desire to have a change in height of the edge of a seat can also be of particular value where the passenger must occupy the seat for a long airplane trip or extended bus ride.

There are, of course, many types of passenger seats, or vehicle seats, that provide for changing the height of the entire seating section. There are also various seat constructions that involve the movement of the seating area along an incline, with such movements usually being coordinated with a seat back recline type of adjustment. However, the provision of separate adjustment means to effect a desired tilt of merely the front edge portion of the seat cushion appears to be a unique modification of a passenger seat to provide for greater occupant comfort.

It is thus a principal object of the present invention to provide a vehicle seating unit with means to adjust the height and tilt for the leading or forward edge portion of the seat cushion.

It is also an object of the present invention to provide a seat construction which utilizes a hinged support means under the front edge portion of the seat cushion and a movable transverse lift bar member to cooperate with the edge support means such that the latter can be raised and lowered as the bar is adjusted through an arcuate path.

Broadly, the present invention provides a vehicle seat unit having an adjustable height front edge portion for the cushioned seat section thereof, which comprises in combination, (a) a movable and tiltable front edge portion of the cushioned seat section that can be raised and lowered with respect to the remaining more-rearward non-moving portion of the cushioned seat section, (b) a transverse hinging support means connecting between the lower rearward part of said movable front edge portion and said non-moving portion of the seat section whereby said front edge portion can pivot up and down with respect to the non-moving portion, (c) a pivoted height adjusting arm member to be moved by a seat occupant that is attached to the side portion of the vehicle seat unit to move in an arc and in a generally vertical plane, and (d) a movable transversely positioned horizontal lift bar member attached to said pivoted arm member a spaced distance above the pivot point for the latter at a level and in a position to move in a fore and aft manner under said movable front edge portion of the cushioned seat section, whereby such lift bar member can, in turn, be moved through an arcuate path and will serve to raise and lower the superposed movable front edge portion for the cushioned seat section.

Typically, a movable cushion supporting section will be utilized along the front edge of the seat and hingedly connected to the remaining, more rearward cushion supporting pan or framing and the seat cushioning will be of one piece of a resilient foam material capable of being compressed, as the front edge portion is lifted, or stretched slightly as the front edge portion is tilted downwardly to provide a lower elevation. It is, however, not intended to limit the construction to any one specific arrangement inasmuch as a separate movable cushioned section could be provided along the entire front edge of the seating section. Also, various types of hinging arrangements may be utilized to attach the cushion supporting sections together and at the same time permit the tilting of the front edge of the seat in order to provide for the varying height adjustments.

In order that the lift bar, which moves through the arcuate path, will raise and lower the front edge portion of the seating section, it is desirable that the bar member can readily move back and forth under the hinged front section. Thus, in a simplified embodiment there can merely be the provision of a smooth surface bar member contacting a smooth, low friction type of surface on the underside of the tilting front support section such that this hinged section can be raised and lowered as the transverse lift bar slides therebelow, with a minimum of friction, in a fore and aft manner, as well as in an arcuate path. In other words, the transverse lift bar member will be positioned and arranged to rest along the underside of a smooth sheet metal or plastic material which, in turn, will serve as the front edge cushion supporting section. Where desired, there may be a multiplicity of rollers, or friction reducing means such as a Teflon coating, between the lift bar member and the lower surface of a cushion supporting section; however, as heretofore set forth, it is contemplated that with low friction types of materials the face-to-face contact between the lift bar on the underside of the hinged portion supporting the front edge of the cushion will be readily operable to effect varying height adjustments for the leading of the cushion.

The height adjusting arm member which is placed along side of the seating unit and in turn utilized to move the transverse lift bar can be provided with a hand grip means in order that the arm member and the transverse lift bar member may be manually moved by the seat occupant to a position which provides comfort for the occupant. On the other hand, where deemed desirable, there may be the use of a spring-biased hydraulic lock means or other types of mechanical position assisting units attached to the adjusting arm member such that it may be controlled by push-button means, rather than by only manual placement to a desired position. In still another embodiment, there may be the utilization of a motor and gear means to effect the back and forth adjustment of the pivoted arm member and the attached transverse lift bar which will in turn effect the raising and lowering of the movable front edge portion of the cushioned seat section.

Reference to the accompanying drawing and the following description thereof will serve to illustrate the construction and arrangement of means which will provide height adjusting and tilting for the front edge portion of a cushioned seat section of a vehicle seating unit and, in addition, will serve to point out variations in construction and operation which may be embodied within the concept.

FIG. 1 of the drawing is a diagrammatic sectional elevational view through a front portion of a vehicle seating unit in order to illustrate one embodiment of an adjustable height front edge portion for the cushioned seating section of the unit.

Figure 2:
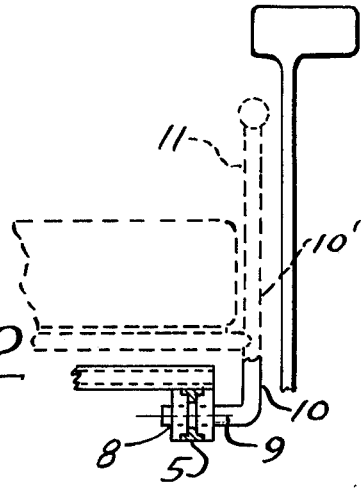

FIG. 2 of the drawing is a diagrammatic partial sectional view through a side portion of the seating unit, as indicated by the line 2—2 in FIG. 1.

Figure 3:
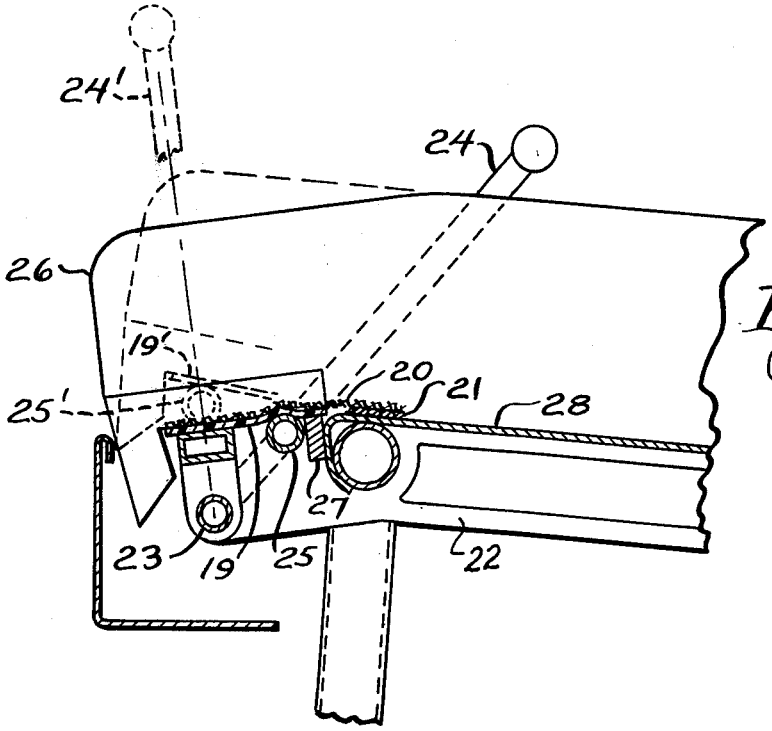

FIG. 3 of the drawing, also a diagrammatic partial sectional elevational view, illustrates a modified construction and arrangement where the hinging of the front movable-tiltable section is accomplished with a pliable material.

Referring now particularly to FIGS. 1 and 2 of the drawing there is shown the front edge portion of a vehicle seat having a cushion section 1 which is indicated as being primarily supported from a pan or strap means 2 and from a movable front edge supporting section 3. The latter is in turn indicated as being attached to the more rearward portion 2 by a hinge means 4. A fore and aft beam or stretcher means is indicated at 5 and a transverse front tubular member is indicated at 6 along with front leg means 7 in order to illustrate conventional adjacent portions of the seat supporting framing.

In order to provide for the tilting of the front edge portion of the seat, there is also a forward portion 5′ for the fore and aft stretcher means 5 in order to accommodate a pivot point and bearing means at 8 for an adjustment arm 10 as well as provide for an additional transverse tubular support member 8 that will serve as a lower movement limiting stop member for the tilting front section 3. As best shown in FIG. 2, the front end portion 5′ for the fore and aft stretcher will provide an enlarged portion as a bearing support means 8 to in turn accommodate a lower horizontal pivot portion 9 for the generally vertical height adjusting arm member 10 so that the latter can move back and forth in a generally vertical plane along the side of the seating unit. For convenience, the upper portion of the arm member 10 may be provided with a grip means 11 such that the seat occupant may manually move and adjust the height of the front edge of the seat. Also, in accordance with the present invention, there is a transverse lift bar member 12 connecting to the vertical adjusting arm member 10 at a point of bearing support means above the pivot point such that lift member 12 will in turn move in an arcuate path.

As best shown in FIG. 1, when transverse lift bar 12 is under the back of the front edge supporting section 3, near the transverse tubular member 6, and generally under the hinge member 4, the section 3 will be permitted to rest in its lowermost positioning against transverse tubular member 8; however, as the height adjusting arm member 10 is moved forwardly towards the front edge of the seat (into the broken line position 10′) and the transverse horizontal lift bar member 12 moves through the arcuate path into positioning 12′, it will be observed that the latter will slide along under the tilting section 3 such that the latter will tilt from hinging means 4 to assume the broken line positioning 3′ and the front edge portion of cushion 1 will, in turn, assume the positioning 1′.

Where desired, various means, such as a notched slot arrangement, may be provided along side of the seating unit to accommodate the back and forth movement for the adjustment arm 10, with the notches providing means for intermediate positionings of the arm member; however, in a simplified construction and arrangement, there may be merely the friction holding of the adjustment arm to any one desired position. The embodiment of FIG. 1 also illustrates the use of spring-biasing to assist in the lowering of the tiltable front edge portion of the seating unit and, along therewith, an assist in the return of the adjustment arm 10 to its lowermost position. Specifically, there is illustrated a lower extended portion 13 for the tilting front cushion supporting section 3, which will carry down around the lower front edge portion of the seat cushion supporting means, and a clip member 14 to provide for the attachment of a tension spring 15 which will have its opposing end connect to a pin means 16 extending from a depending leg member 17 as a part of the stretcher member 5. The use of the tension spring 15 between the seat framing and the movable front edge supporting portion for the cushion section insures the automatic lowering and retraction of the front edge adjustment means; however, in most instances it is believed that the weight of the legs and thighs of the seat occupant will be sufficient to insure the lowering of the adjustable front edge portion of the seat cushion.

In FIG. 3 of the drawing, there is indicated a modified construction and arrangement to the extent that the hinging between a rearward cushion supporting pan 18 and a movable-tiltable supporting member 19 is provided by a flexible plastic or fabric means. For example, there may be a strip of Velcro 21 extending along the upper front edge portion of pan 18 and a flexible material 20 of a suitable fabric, or of a flexible plastic material with a fabric facing which will attach to the Velcro, used as the hinging material to extend forwardly and be attached to the supporting member 19. The remaining portion of the height adjustment means can be similar to that shown in FIG. 1 with a fore and aft stretcher member 22 providing a lower pivot point and bearing means 23 for an arm member 24 which, in turn, will connect with and support a transverse lift bar member 25 that will then be movable in an arcuate path to raise and lower the tiltable support piece 19. Again, the lower surface of supporting section 19 should be of a relatively low friction type of construction such that bar member 25 can slide back and forth along such surface without undue friction and without undue effort in effecting the adjustment of arm member 24.

In the present embodiment, the lowermost positioning for the front edge of the cushioning 26 will occur with lift bar member 25 against a stop member 27, which in turn is indicated as mounted against the front depending portion of the supporting pan 18, and the pivoted adjusting arm member 24 is in the most rearward position. Conversely, the uppermost positioning for the front edge of the cushioning 26 will occur as the adjusting arm member 24 is moved forward to the broken line positioning 24' to, in turn, move the transverse lift bar 25 in a sliding engagement under the front supporting section 19 such that the latter will be elevated into a tilting dashed line positioning 19' and transverse bar moves to the positioning 25'.

As heretofore noted, it is not intended to limit the present construction and arrangement to the use of any one type of hinging means nor to the use of any predetermined types of construction materials. The hinge 4 of FIG. 1 may be of the continuous "piano" type on a series of spaced separate hinges, while the tilting portion 19 may be made of a smooth surfaced plastic material which will permit the easy movement of transverse bar member 25 along its underside. Preferably the tiltable support section will be of a thoroughly rigid material capable of lifting the front edge portion of the cushioning without undue sagging or deformation. Also, where desired, the section 19 may be provided with one or more preformed indentations that extend transversely across the seat so as to accommodate various positionings for the transverse lift bar member 25. Thus, the latter can be brought to rest in the one or more intermediate indentations, or humps, to provide varying height adjustments for the leading edge of the seat cushion.

Although not shown in the drawing, it will be obvious to those skilled in seat manufacturing, and particularly those familiar with tilting seat back arrangements, that spring-biased hydraulic locks or other mechanical adjuster means may be attached to the adjustable arm members, such as 10 in FIG. 1 and 24 in FIG. 3, such that there may be mechanical assistance in moving the adjustment handle or arm member in acquiring any desired resulting height adjustment for the front edge of the seat cushion. It may also be noted that spring-biased means may be utilized for the arrangement of FIG. 3 in a manner similar to that shown and described in connection with FIG. 1 of the drawing.

I claim as my invention:

1. A vehicle seat unit having a unitary cushioned seat section, and an adjustable height front edge portion for said cushioned seat section, said portion comprising in combination, a. a movable and tiltable front edge portion underneath the forward portion of said cushioned seat section that can be raised and lowered with respect to the remaining more-rearward non-moving portion of the cushioned seat section, b. a transverse hinging support means connecting between the lower rearward part of said movable front edge portion and said non-moving portion of the seat section whereby said front edge portion can pivot up and down with respect to the non-moving portion, c. a pivoted height adjusting arm member to be moved by a seat occupant that is attached to the side portion of the vehicle seat unit to move in an arc and in a generally vertical plane, and d. a movable transversely positioned horizontal lift bar attached to said pivoted arm member a spaced distance above the pivot point for the latter at a level and in a position to move in a fore and aft manner under said movable front edge portion of the cushioned seat section, whereby such lift bar member can, in turn, be moved through an arcuate path and will serve to raise and lower the superposed movable front edge portion for the cushioned seat section, and e. a supporting means for said front edge portion of said cushion seat section, said supporting means having a low friction surface from the underside thereof for contact with said movable transversely positioned horizontal lift bar.

2. The vehicle seat unit of claim 1 further characterized in that said pivoted height adjusting arm member is provided with hand grip means to provide for manual movement thereof and front seat edge adjustment.

3. The vehicle seat unit of claim 1 further characterized in that said transverse hinging support means provides for at least one mechanical hinging member between the movable and tiltable front edge portion of the cushion seat section and the more rearward non-moving portion thereof.

4. The vehicle seat unit of claim 1 further characterized in that said transverse hinging support means provides for the use of a flexible material between the movable and tiltable front edge portion of the cushion seat section and the more rearward non-moving portion thereof.

5. The vehicle seat unit of claim 1 further characterized in that tension spring means is provided to assist in the lowering and downward tilting of said movable and tiltable front edge portion of the cushion seat section.

* * * * *